United States Patent [19]

von Herrmann et al.

[11] 4,199,539

[45] Apr. 22, 1980

[54] METHOD FOR MONITORING AND CONTROLLING THE OPERATION OF A DUAL PLATEN PRESS

[75] Inventors: Pieter J. von Herrmann; Ronald S. Williams, both of Wilmington, N.C.

[73] Assignee: General Electric Company, San Jose, Calif.

[21] Appl. No.: 871,738

[22] Filed: Jan. 23, 1978

Related U.S. Application Data

[62] Division of Ser. No. 641,327, Dec. 16, 1975, abandoned.

[51] Int. Cl.[2] ..... G21C 21/00

[52] U.S. Cl. ..... 264/0.5; 264/120; 264/239; 425/140; 425/149; 425/171

[58] Field of Search ..... 264/0.5, 120, 239; 425/140, 149, 171

[56] References Cited

U.S. PATENT DOCUMENTS

| | | | |
|---|---|---|---|
| 2,821,907 | 2/1958 | Stone | 100/99 |
| 3,105,907 | 10/1963 | Colten et al. | 250/202 |
| 3,250,993 | 5/1966 | Weaver | 324/77 H |
| 3,559,247 | 2/1971 | Larsson | 425/149 |
| 3,642,401 | 2/1972 | Wilson | 425/137 |
| 3,647,309 | 3/1972 | Thompson | 425/150 |
| 3,761,546 | 9/1973 | Wilheim et al. | 264/0.5 |
| 3,763,292 | 10/1973 | Stradley et al. | 264/0.5 |

*Primary Examiner*—Leland A. Sebastian

*Attorney, Agent, or Firm*—Ivor J. James, Jr.; Samuel E. Turner; Sam E. Laub

[57] ABSTRACT

A method for monitoring and controlling the operation of a dual platen press used in the manufacture of nuclear fuel pellets is disclosed. The method comprises the steps of indicating the displacements of both platens and imposing the displacements of the platens on orthogonal axes such that the displacements jointly control the motion of a point which traces a lissajous figure representative of the displacement and relative velocity of the press platens. A second lissajous figure representing the desired platen movements and relative velocity may be superimposed on the first lissajous figure, differences between the first and second lissajous figures indicating deviations from the desired operation of the press. Alternately, a press operator may simply use the first lissajous figure constructed from the actual platen displacements to analyze the operation of the press. The completion of preselected portions of the first lissajous figure may be detected and used to trigger subsequent press operations. Mechanical, optical and electrical embodiments of devices for implementing the method are disclosed.

7 Claims, 18 Drawing Figures

FIG. 2(a)
UPPER PLATEN DISPLACEMENT
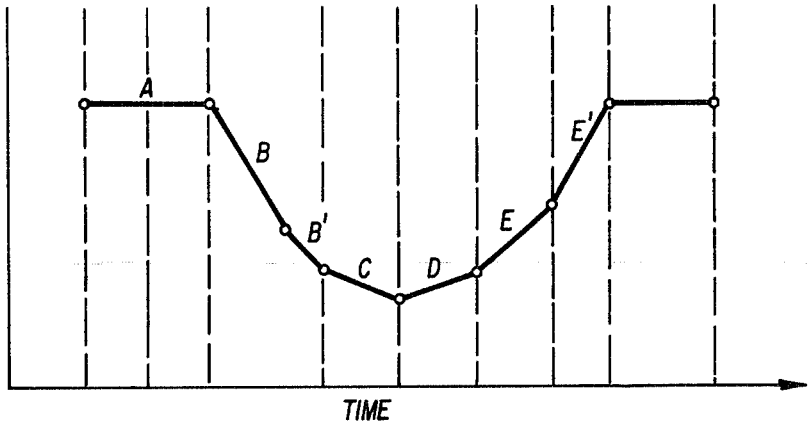
FIG. 2(b)
LOWER PLATEN DISPLACEMENT
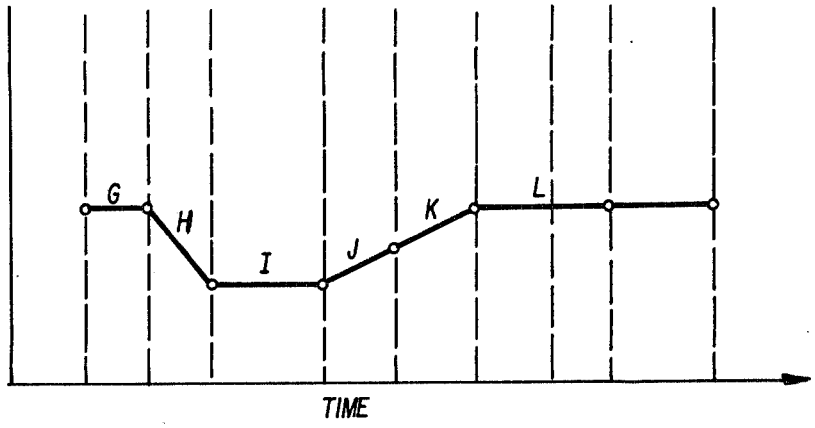
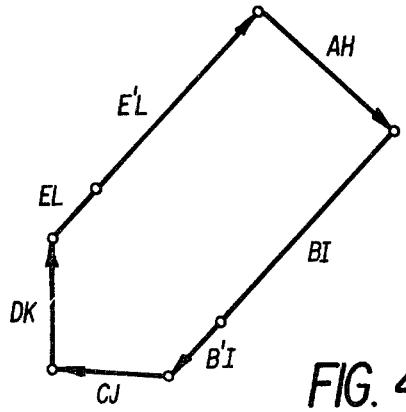
FIG. 4

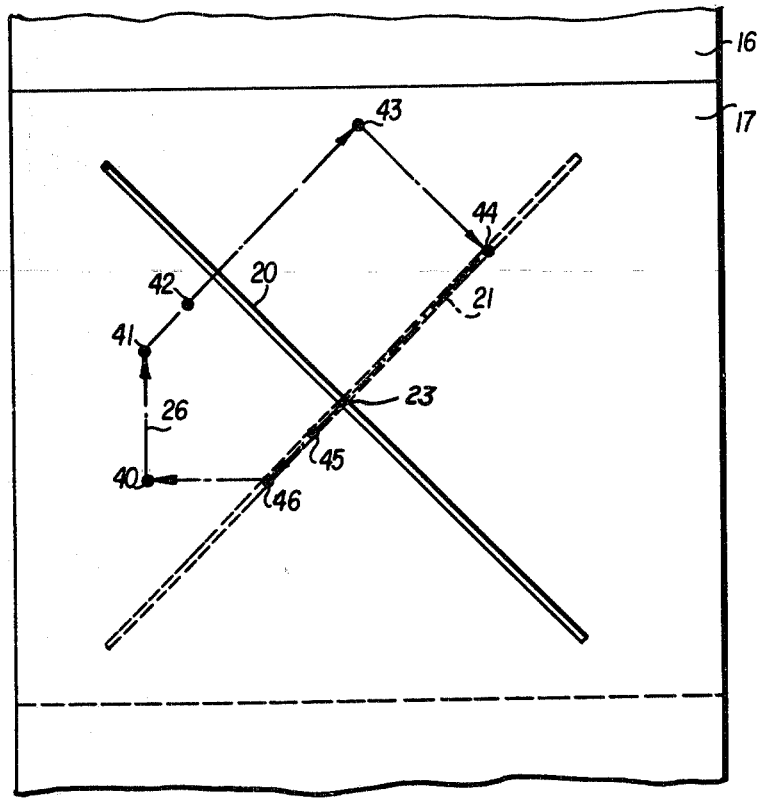
FIG. 3
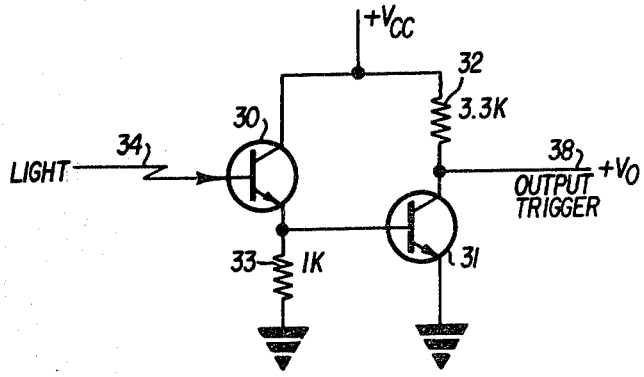
FIG. 5
FIG. 7
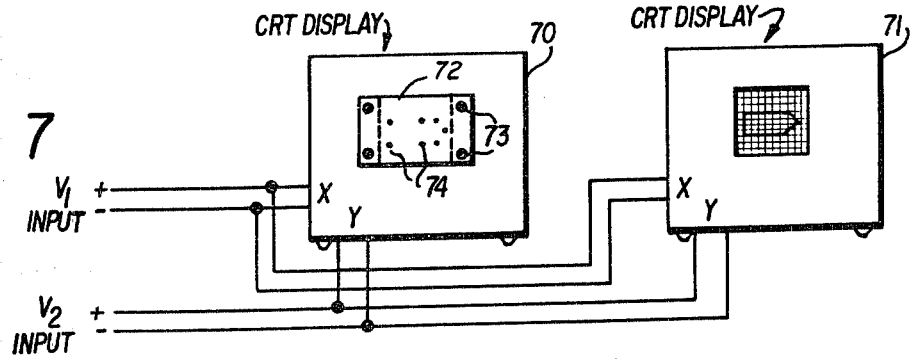

METHOD FOR MONITORING AND CONTROLLING THE OPERATION OF A DUAL PLATEN PRESS

This is a division of application Ser. No. 641,327, filed Dec. 16, 1975, now abandoned.

BACKGROUND OF THE INVENTION

1. Field of the Invention

The invention relates to a method for monitoring and controlling the operation of a dual platen press. The invention is particularly useful where dual platen presses are used in the manufacture of nuclear fuel pellets since small variations in the operation of the press during the manufacture of nuclear fuel pellets can cause undesirable variations in fuel pellet densities and have a deleterious effect on fuel pellet integrity.

2. Background of the Invention

Devices for providing a visual indication or an electrical signal representative of the displacement of a single press platen are common in the prior art. However, these prior art platen displacement indicating devices are found to be of limited usefulness when used with a dual platen press. This is because information regarding the relative displacement and relative velocity of the press platens is required for adequately monitoring and controlling the operation of a dual platen press.

Devices for providing a visual indication of the relative displacement of the platens of a dual platen press may be seen in the prior art. However, these prior art devices generally provide no more than a pair of visual indicators moving simultaneously on a vertical scale. The usefulness of this type of device is limited because information regarding the relative displacement of the platens may be obtained by the observer only by comparing the relative displacements of the two indicators. Also, this type of device provides no indication of the relative velocity of the press platens. Thus, there is a general need in the dual platen press art for a device that accurately records each of the platen displacements of a dual platen press and provides an indication of the relative displacement and relative velocity of the press platens.

In the manufacture of nuclear fuel, normally fuel in the form of $UO_2$ powder is pressed into pellets which are then sintered and assembled within a tubular cladding to form a complete nuclear fuel element. It is imperative that the fuel pellets be of a known and uniform density for reasons related to the nuclear design of the reactor as well to protect fuel pellet integrity. Variations in the density of the pellet before sintering can result in fuel pellets that crack after sintering or after extended use in a nuclear reactor. Thus, the need for a device that accurately indicates the relative displacement and relative velocity of the platens of a dual platen press is critical where such a press is used in the manufacture of nuclear fuel pellets. Such a device would be used to continuously, or periodically monitor the operation of the press to ensure a maximum yield of acceptable fuel pellets.

Hydraulically actuated dual platen compacting presses are normally used in the manufacture of nuclear fuel pellets since they offer the capability of widely varying a large number of pressing parameters and various $UO_2$ fuel powders have different pressing requirements. It is common for hydraulically actuated dual platen compacting presses to provide the ability to vary compaction speed, ejection speed, the relative movement of upper and lower platens, compaction pressure and ejection hold-down force. However, experience has shown that it is extremely difficult to determine the proper pressing parameters for a given $UO_2$ powder and then accurately adjust the compacting press to meet those requirements. Even knowing the correct pressing parameters for a given $UO_2$ powder it is often extremely difficult to duplicate those parameters when setting up the compacting press. An art dependent upon the skill of the operator rather than a scientifically repeatable procedure has developed associated with determining and/or duplicating the proper press set-up for producing a maximum yield of acceptable fuel pellets from a given type of $UO_2$ powder. And thus, a need has developed for a device that accurately correlates the various pressing parameters to actual platen displacements, the relative displacement of the platens and relative velocity of the platens. Such a device would be used to aid a press operator both in analyzing press operations for determining a good press set-up and duplicating a press set-up for a given type of $UO_2$ powder.

In dual or single platen presses, in general, the various portions of the press cycle are initiated and terminated by the displacements of the press platens which actuate various microswitches. The present invention provides a method for generating signals that are used to terminate and intiate various portions of the press cycle without the use of microswitches.

Accordingly, it is a principal object of the present invention to provide a method for controlling the operation of a dual platen press.

Another object of the present invention is to provide a method utilizing both visual and recorded outputs for indicating the relative displacement and relative velocity of the platens of a dual platen press.

Another object of the present invention is to provide a method for accurately recording the platen displacements of a dual platen press and deriving the relative displacement and relative velocity of the platens therefrom for the purpose of monitoring and analyzing the operation of the press.

Another object of the present invention is to provide a method for the manufacture of nuclear fuel pellets which correlates the various pressing parameters of a dual platen press to the actual displacements, the relative displacement and the relative velocity of the press platens for the purpose of more rapidly and accurately determining, or duplicating, the correct pressing parameters for a given type of $UO_2$ powder.

SUMMARY OF THE INVENTION

Briefly stated, these and other objects of the invention are carried out by constructing lissajous figures from the platen displacements of a dual platen press. The lissajous figures so constructed are representative of the movements and relative velocity of the press platens. The term movement as hereinafter used is intended to include both the actual displacements and relative displacement of the press platens. According to the invention, the displacements of both platens of a dual platen press are measured. The displacements are then imposed on orthogonal axes such that they simultaneously control the motion of a point which traces a lissajous figure. The lissajous figure so constructed may then be superimposed on a second lissajous figure representative of the desired platen movements and relative velocity, deviations between the lissajous figure constructed from the actual platen displacements and the second lissajous figure indicating deviations from the desired press operation. The slope of various portions of the first lissajous figure constructed from the actual platen displacements provides an indication of the relative velocity of the press platens during the portion of the press cycle being examined. The actual displacement of the press platens may be measured directly from various portions of the lissajous figure and the relative displacement of the platens is provided by a comparison of these portions. Thus, a press operator may simply use the first lissajous figure to analyze the operation of the press. A method of controlling the press is provided wherein the completion of preselected portions of the lissajous figure is detected and used to terminate and initiate various portions of the press cycle. Mechanical, optical and electrical devices for constructing lissajous figures from the displacements of both platens of a dual platen press are provided.

DESCRIPTION OF THE DRAWINGS

FIGS. 2(*a*) and 2(*b*) are typical time versus displacement graphs for the two platens of a dual platen press.

FIG. 3 is a partial side view of the device of FIG. 1 taken along line 3—3.

FIG. 3 is a lissajous figure constructed by the device shown in FIG. 3 when the platen displacements of FIGS. 2(*a*) and 2(*b*) are monitored.

FIG. 5 is a schematic representation of a photoelectric tripping circuit that may be used with the invention.

FIG. 7 illustrates an arrangement for using a cathode ray tube display with the embodiment of FIG. 6.

DESCRIPTION OF THE PREFERRED EMBODIMENTS

Figure 1:
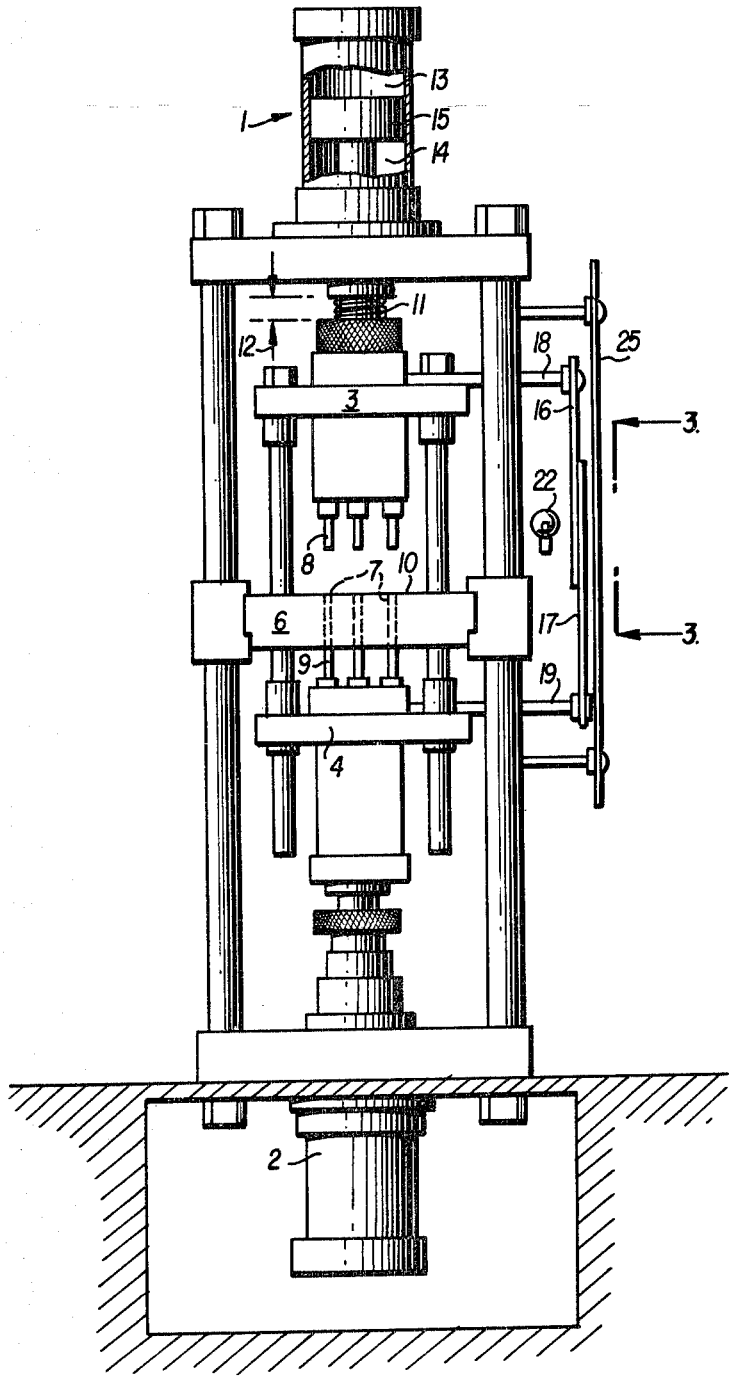
FIG. 1 is an elevational, partially schematic view of a hydraulic dual platen press incorporating one embodiment of the invention.

Referring to FIG. 1, a hydraulic dual platen press is depicted. The press includes upper and lower hydraulic actuators 1 and 2 which control the movement of upper and lower platens 3 and 4, respectively. In the area between the upper and lower platens 3 and 4 there is a die table 6 having a plurality of die cavities 7 therein. The upper and lower platens 3 and 4 each carry a plurality of cylindrical rams 8 and 9 each of which is associated with a single die cavity. Hydraulically actuated platens 3 and 4 move the rams 8 and 9 in and out of the die cavities in a vertical direction to effect compaction of the $UO_2$ powder deposited therein and ejection of the compacted nuclear fuel pellet thereby formed.

The normal sequence of operations starts with the lower platen 4 positioned so that the lower rams 9 are even with the top surface 10 of the die table 6. The lower platen is then moved down and the die cavities are filled with the desired depth of $UO_2$ powder. The upper platen 3 then moves down so that the upper rams 8 are even with the top surface 10 of the die table 6. The upper and lower platens then move together in exactly equal amounts to effect compaction of the $UO_2$ powder. The upper and lower platens then move upwardly to eject the compacted nuclear fuel pellets from the top of the die cavities. During the ejection portion of the press cycle the rams 8 associated with upper platen 3 remain in contact with the compacted nuclear fuel pellets for the purpose of exerting a hold-down force on the pellets. Spring pressure or pressure generated in the upper hydraulic actuator 1 may be used to provide this ejection hold-down force.

When spring pressure is used to generate ejection hold-down force the press is normally referred to as being in a standard ejection cycle. In the standard ejection cycle, immediately upon the completion of the compaction portion of the press cycle hydraulic pressure in the upper hydraulic actuator 1 is released allowing a spring 11 to establish a gap 12. As the ejection cycle proceeds the lower ram pushes the fuel pellet out of the top of the die cavity and with the gap 12 established the spring 11 provides a relatively constant hold-down force. Hold-down force may be varied in the standard ejection cycle for different press set-ups by adjusting the spring gap 12 to change the spring preload or by replacing the spring 11 with other springs having different spring constants.

Hold-down forces generated by hydraulic pressure are generally used when the pressing operation requires greater hold-down forces than may be generated by spring pressure. Hydraulic hold-down force is generated by manipulation of the pressures in the chambers 13 and 14 above and below the piston 15 of the power hydraulic actuator 1. The pressure above the piston is generally referred to as the back pressure and the pressure below the piston is generally referred to as the weight control pressure. Hydraulic hold-down force may be generated by the use of back pressure only or by a combination of back pressure and weight control pressure which is established at the beginning of the ejection cycle. When hold-down force is hydraulically actuated the spring gap 12 is closed.

According to the invention, a method for monitoring, analyzing and controlling the operation of the dual platen press just described is provided. The method is comprised of the following steps. The displacements of the upper and lower platens 3 and 4 are measured and optical, mechanical or electrical signals representative of these displacements are created. These signals are then imposed on orthogonal axes, such that the displacements of the press platens simultaneously control the motion of a point which traces a plane curve, which in the present case is a lissajous figure. Lissajous figures are generally known as plane curves traced by a point which executes two independent harmonic motions in orthogonal directions. The lissajous figure constructed according to the present method may be used by a press operator directly or in combination with a second lissajous figure representative of the desired platen displacements. In the former case the operator uses the lissajous figure directly as a basis for monitoring and analyzing the operation of the press. In the latter case the operator may use the invention to monitor and analyze the operation of the press by superimposing the first lissajous figure, constructed from the actual platen displacements, on the second lissajous figure which serves as a standard for the type of press operation being run, deviations between the first and second lissajous figures indicating deviations from the desired press operation.

Whether used in combination with a second lissajous figure or not, the first lissajous figure provides the press operator with an important diagnostic tool for monitoring and analyzing press operations. The slope of various portions of the first lissajous figure indicates the relative velocity of the press platens during that portion of the press cycle being examined. The displacement of the press platens may be measured directly from various portions of the first lissajous figure and the relative displacement of the platens is provided by a comparison of these portions. The lissajous figures constructed according to this method will thus aid the press operator in monitoring and analyzing press operations and adjusting the various pressing parameters for duplicating a good press set-up, or determining a good press set-up for the first time. The invention also provides a method of eliminating the various microswitches which are generally used to detect platen displacements and initiate and terminate various portions of the press cycle. This function is carried out by providing for the detection of preselected portions of the first lissajous figure, and thereby triggering subsequent press operations.

Referring now mainly to FIGS. 2(*a*) and 2(*b*), a typical pressing cycle for a dual platen press, used in the manufacture of nuclear fuel pellets, will be described in in detail. FIG. 2(*a*) represents the displacement versus time graph for the upper platen and FIG. 2(*b*) represents the displacement versus time graph for the lower platen. Line segments on each of the graphs are designated with capital letters. With the platens in their initial positions, as indicated by line segments A and G, both platens are stationary while $UO_2$ powder is deposited on the die table above the die cavities. In position A, the upper platen 3 and rams 8 are completely withdrawn from the die cavity. In position G, the lower platen 4 is positioned so that the rams 9 are flush with the top surface 10 of the die table 6. Next, the lower platen moves down, as indicated by line segment H, and $UO_2$ powder enters the die cavities. The lower platen remains stationary, as indicated by line segment I, while the upper platen moves down, first rapidly, as indicated by line segment B, and then more slowly, as indicated by line segment B', as the rams 8 approach the top surface 10 of the die table 6. At the end of line segment B the rams 8 are even with the top surface 10. Next, the two platens move toward one another in exactly equal amounts at identical speeds, indicated by line segments C and J. This compresses the powder deposited in the die cavities to form the fuel pellets. During the next portion of the press cycle, the lower platen continues to move up while the upper platen reverses direction so that both platens move up with identical motions, as indicated by line segments D and K. This is normally referred to as the ejection portion of the press cycle. The upper platen then gradually lifts off the pellets, as indicated by line segment E, and then retracts more rapidly, as indicated by line segment E'; while the lower platen reaches the top of the die table and stops its motion, as indicated by line segment L. This completes the press cycle and both platens are now in position for initiating the next press cycle.

A simple mechanical and optical device for constructing a lissajous figure corresponding to the two platen displacements just described is illustrated in FIGS. 1 and 3. The device comprises two plates 16 and 17 which are mounted on the side of the press overlapping one another. Plate 16 is connected to the upper platen 3 by member 18 while plate 17 is connected to the lower platen 4 by member 19. The plates have diagonal slots 20 and 21 arranged such that the two slots are at right angles to one another and overlap each other. Normally, each slot is at an angle of 45° to the vertical. In one embodiment of the invention, a light source 22 is placed behind the plates to provide a beam of light which penetrates the intersection 23 of the slots 20 and 21. In other embodiments of the invention a pen or a heat marker may be mounted at the intersection of the slots.

As the platens move through the cycle illustrated in FIGS. 2(*a*) and 2(*b*), the intersection 23 of the two slots 20 and 21 moves through a definite pattern. This pattern is shown in FIG. 4 and is the lissajous figure of the press operation illustrated in FIGS. 2(*a*) and 2(*b*). In FIG. 4, the same nomenclature as that employed to identify the line segments of FIGS. 2(*a*) and 2(*b*) is combined to indicate which portions of the line segments of FIGS. 2(*a*) and 2(*b*) correspond to each portion of the lissajous figure. For example, portion AH is created with the upper platen stationary while the lower platen moves down such that the intersection of the slots describes a straight line at an angle of 45° to the vertical. Another example is the horizontal portion marked CJ. Here the two platens and thus the two plates move in opposite directions by exactly equal amounts. This causes the intersection of the slots to move horizontally from right to left. If the platens do not move in a synchronous manner, at equal velocities, the slope of the line CJ will vary. A further example is the portion DK where both platens move up in unison so that the intersection of the slots describes a line moving in the vertical direction. The gradual lift off the upper ram while the lower ram remains stationary can be seen by the diagonal line segments EL and E'L. Thus, a complete lissajous figure is described which is representative of the movements and relative velocity of the press platens.

For monitoring purposes a transparent plate 25 having the desired lissajous figure 26 enscribed thereon may be mounted over the two plates 16 and 17. Then as the two plates 16 and 17 move through a press cycle, the operator will be assured of the correct operation of the press as long as the light beam exiting the intersection 23 of the two slots travels along the lissajous figure 26 enscribed on the transparent plate 25. In embodiments of the invention having a pen or a heat marker mounted at the intersection of the slots a suitable drawing surface is provided upon which the lissajous figure resulting from the operation of the press may be enscribed.

If a moving light beam is used to form the lissajous figure, means for detecting preseleted portions of the lissajous figure and triggering subsequent press operations therefrom may be provided. FIG. 5 illustrates a simple light actuated tripping circuit which may be employed with the embodiment of the invention illustrated in FIG. 1. This type of circuit is well known to those skilled in the electrical arts and may be broadly described as a Schmidt trigger. The collector of photosensitive transistor 30 is connected to a biasing voltage $V_{cc}$. The emitter of photosensitive transistor 30 is connected to the base of an output transistor 31 and to ground through a resistor 33. The collector of output transistor 31 is connected to an output trigger line 38 and to biasing voltage $V_{cc}$ through resistor 32. The emitter of output transistor 31 is connected to ground. The base of transistor 30 is arranged to receive a light beam, designated by 34, from the light source 22.

In a specific example of a circuit of the type shown in FIG. 5 which is suitable for use with the present invention, the phototransistor 30 is a Fairchild FPT131, the output transistor 31 is any 2N222 transistor and resistors 32 and 33 are 3.3k ohms and 1k ohms, respectively. In the operation of the circuit light beam 34 impinging upon the face of the phototransistor 30 causes the transistor 30 to become conductive, providing a voltage to the base of output transistor 31. The output transistor 31 now becomes conductive thereby providing an output trigger for line 38. The output trigger line 38 is connected in any suitable manner to initiate and terminate operations of the press.

Referring now again to FIG. 3, normally a plurality of such photoelectric tripping circuits will be provided having photosensitive transistors 30 mounted on the overlying plate 25 at points 40 through 46. The phototransistors are arranged to detect the completion of preselected portions of the lissajous figure constructed, as previously described, by movement of the intersection 23 of the slots 20 and 21. When light from the light beam tracing the lissajous figure impinges the face of one of the phototransistors mounted at points 40 through 46 on plate 25 the output of the circuit illustrated in FIG. 5 is used to trigger subsequent portions of the pressing cycle. The microswitches now ordinarily used to terminate and initiate various portions of the press cycle will thus be eliminated.

Modifications may be made in the embodiment just described without departing from the spirit of the invention. For example, the plates 16 and 17 may be connected to the rams mechanically or hydraulically. A hydraulic link between the device just described and the press platens would allow the device to be remotely placed from the press. It may be desirable to utilize only a portion of the lissajous figure to simply obtain the most important sections corresponding to the compaction and ejection portions of the press cycle, respectively. Thus, a device which is actuated only during those sections may be provided.

Figure 6:
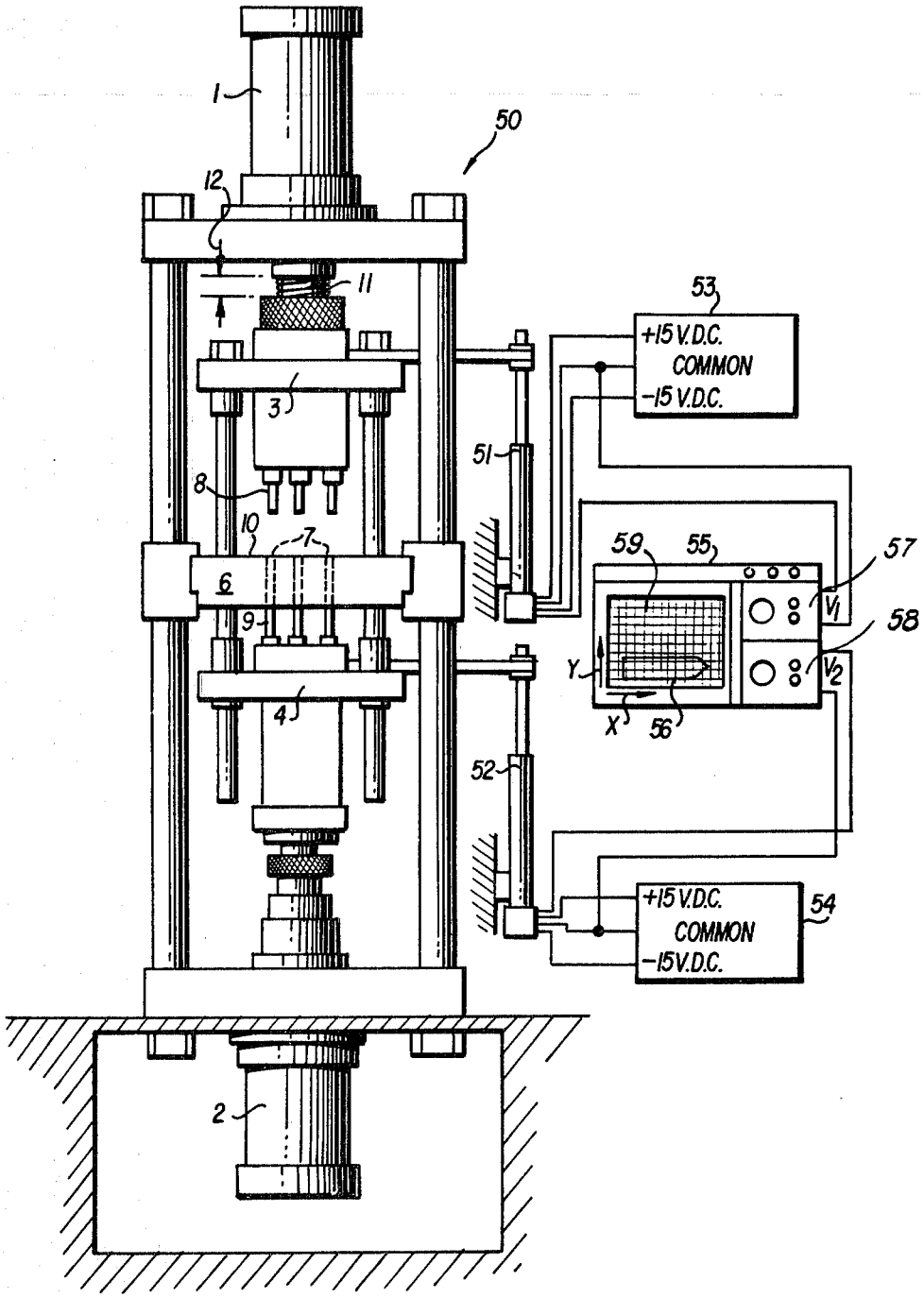
FIG. 6 is an elevational, partially schematic view of a hydraulic dual platen press incorporating another embodiment of the invention.

Referring now to FIG. 6, an electrical embodiment of the device is illustrated. The dual platen press 50 depicted in FIG. 6 is the same type of press shown in FIG. 1 and like components are given the same identifying numbers. In the electrical embodiment linear variable differential transformers (LVDT's) 51 and 52 are mounted to the upper and lower platens 3 and 4, respectively. LVDT units are well known to those skilled in the electrical arts and the units used here are used to translate linear motion into linear DC electrical signals. The LVDT units 51 and 52 are powered by power supplies 53 and 54, respectively. The output signals $V_1$ and $V_2$ from the LVDT units 51 and 52 are supplied to the X and Y terminals 57 and 58 of a recorder 55 for the purpose of producing a lissajous figure 56 on graph paper 59 representative of the operation of the press. The recorder 55 may be any of a number of readily available conventional electrical recording devices. For example, the recorder may also be a cathode ray tube and the signals provided to the terminals 57 and 58 may be employed to drive the X and Y deflection circuits of the cathode ray tube (for example see FIG. 7).

In one specific example of this electrical embodiment, the LVDT unit 51 is a Shaevitz unit, number 5000 DC-B and LVDT unit 52 is Shaevitz unit, number 2000 DC-B. These LVDT units translate linear motion into ±10 VDC linear electrical signals. The power supplies 53 and 54 are Shaevitz, number PSM 120, ±15 VDC power supplies. The recorder 55 is a Hewlett Packard Model 7035 B X-Y recorder.

Referring now to FIG. 7, an alternate arrangement for displaying a lissajous figure representative of the operation of the press and for detecting the completion of preselected portions of the lissajous figure is illustrated. FIG. 7 shows cathode ray tubes (CRT's) 70 and 71 connected to receive electrical signals $V_1$ and $V_2$ from LVDT units 51 and 52, respectively. The CRT 71 provides a visual display which may be used by the operator to monitor and analyze press operations and/or for a comparison with a standard lissajous figure representing the desired platen displacements. The CRT 70 is provided as a means for detecting the completion of preselected portions of the lissajous figure constructed from the actual platen displacements. The CRT 70 is covered with a mask 72 attached to the front of the CRT by the screws 73 or the like. The mask 72 has a plurality of phototransistors 74 mounted thereon such that the phototransistors receive light from the lissajous figure traced by the CRT 70. Each of the phototransistors 74 is actually part of a photoelectric tripping circuit such as the one in FIG. 5 so that light impinging the faces of the phototransistors controls an output trigger which may be used to terminate and initiate portions of the pressing cycle.

Figure 8:
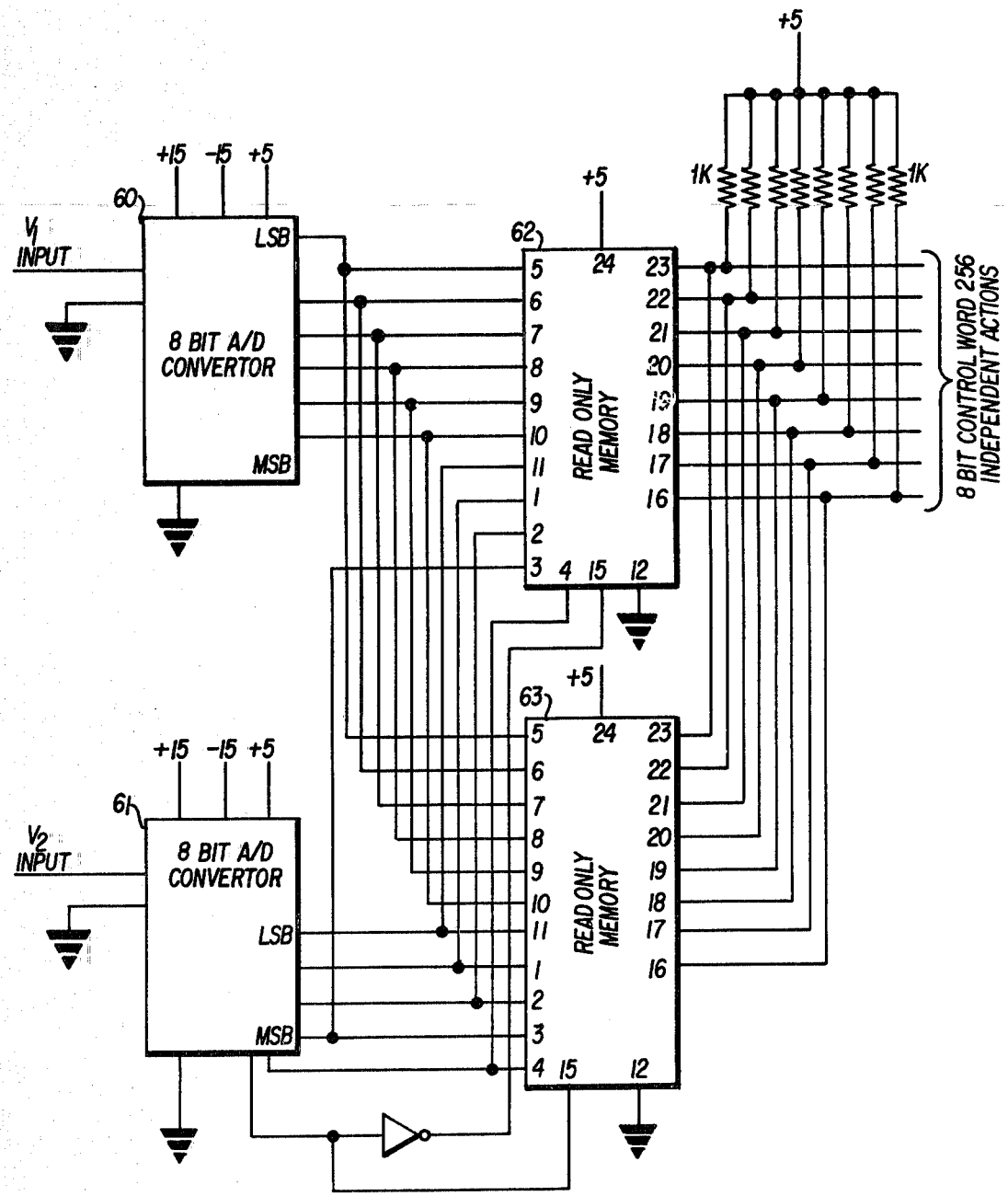
FIG. 8 is a schematic representation of a voltage comparison circuit that may be used with the embodiment shown in FIG. 6.

FIG. 8 illustrates a simple voltage comparison circuit which will generate an 8-bit digital control word from LVDT signals $V_1$ and $V_2$. This type of circuit is well known to those skilled in the electrical arts. The signals from the LVDT units 51 and 52 are inputed to 8-bit analogue-to-digital converters 60 and 61, respectively, where the signals $V_1$ and $V_2$ are converted into a binary code. Analogue-to-digital converters 60 and 61 are connected to read only memories 62 and 63 by a conventional arrangement which accounts for most significant and least significant bits. The output of the read only memories 62 and 63 is combined to provide an 8-bit control word which is used to control subsequent press operations. The analogue-to-digital converters 60 and 61, and the read only memories 62 and 63 are of a type readily available commercially. By way of example analogue-digital-converters sold by Analog Devices, Inc., part number ADC 8ZM may be used at 60 and 61. Read only memories suitable for 62 and 63 are sold by Intel, Inc., part number 2316A ROM. In the operation of the circuit analogue signals $V_1$ and $V_2$ from LVDT units 51 and 52 are converted into an 8-bit digital control word which may be used to directly terminate and initiate portions of the press cycle, or inputed to a digital processor to produce a sequence of programmed responses. The mechanically actuated microswitches which are ordinarily used to trigger subsequent portions of the press cycle may thus be eliminated.

FIGS. 9(*a*) through 9(*i*) are examples of various lissajous figures obtained from the devices described above. These figures are employed in the following description to illustrate the manner in which the lissajous figures constructed in accordance with this invention may be analyzed in terms of press operations. Various portions of the press cycle are labelled with the nomenclature of FIG. 4 to identify the sequence of press operations. The lissajous figures of FIGS. 4 and 9 differ only in the orientation of the orthogonal axes upon which the platen displacements are imposed. Line segment AH indicates the lowering of the lower platen to fill the die cavity; BI and B'I indicate the downward movement of the upper platen; CJ represents the compaction of the powder in the die cavity; DK represents the ejection of the compacted nuclear fuel pellet; and line segments EL and E'L represent the raising of the upper platen at the end of the press cycle.

FIGS. 9(*a*) through 9(*i*) each represent a different press set-up for the manufacture of 0.5 inch high nuclear fuel pellets from a depth of fill in the die cavity of 1.0 inch. FIG. 9(*a*) illustrates a lissajous figure observed from a press set-up that was termed "good" by production personnel skilled in setting up dual platen hydraulic pressed for the manufacture of nuclear fuel pellets. In FIG. 9(*a*) the solid curve 80 represents the lissajous figure constructed from the actual platen displacements. Curve 80 is shown superimposed on the ideal lissajous figure 81 (arrows and broken lines) to show deviations in the operation of the press. A standard ejection cycle was used in this pressing cycle, meaning that hold-down force exerted by the upper ram during the ejection portion of the press cycle was generated by spring pressure rather than hydraulic pressure. In this press operation the ideal lissajous figure indicates that the Y component of the ejection portion of the curve should be three times greater than the Y component of the compaction portion of the durve, assuming equal compaction from the upper and lower platens. This is obvious from a dimensional analysis of the compaction operation. With a 1.0 depth to fill, to obtain a 0.5 inch pellet both rams, and thus both platens, must move 0.25 inches during the compaction portion of the press cycle. This puts the bottom of the pellet 0.75 inches from the top of the die table, and both the upper and lower rams must move upward 0.75 inches to complete ejection of the pellet. The ratio of the Y components of the ejection and compaction curves is therefore 0.75:0.25, or 3:1. A comparison of the lissajous figure constructed in FIG. 9(*a*) with the reference marks (X and 2X) in FIG. 9(*a*) shows that the ratio is less than 3:1 indicating more compaction by the lower platen than is desirable despite the fact that this was thought to be a "good" press set-up. The basically 45° slope of the ejection portion DK and compaction portion CJ of the lissajous figure of FIG. 9(*a*) indicates that the speed of the upper and lower platens was identical during the compaction and ejection portions of the press cycle. The small amount of horizontal travel, indicated by the numeral 82, at the initiation of the ejection portion of the press cycle indicates that the upper ram moved away from the pellet at the beginning of the ejection cycle. The velocity of the upper platen exceeded that of the lower platen at this point due to spring pressure relaxing during the establishment of the spring gap and the lower ram overcoming the initial friction of the pellet in the die cavity. The change in slope at the end of the ejection cycle, indicated by the numeral 83, indicates that the lower platen speed increased during ejection which probably caused the spring gap to close at the end of the ejection cycle. The fact that a press set-up which produced a lissajous figure having these deviations was termed "good" by production personnel skilled in the art of setting-up dual platen presses for the manufacture of nuclear fuel, but not having the benefit of the present invention, is indicative of the improved analysis of the pressing operation made possible by the present invention.

FIG. 9(*b*) illustrates a lissajous figure representing a press cycle with overpressing of the upper platen. A standard ejection cycle is used again. The ratio of the Y components of the ejection and compaction portions of the curve (approximately 9:1) indicates that the upper platen is pressing approximately 3 times as much as the lower platen. This is due to the lower platen being actuated too late during the compaction portion of the press cycle since the basically 45° slopes of both the ejection portion DK and compaction portion CJ of the lissajous figure indicates that platen speeds were matched. The overall shape of the ejection portion of the lissajous figure is identical to that of FIG. 9(*a*) since only the pressing location in the die was changed.

FIG. 9(*c*) illustrates a lissajous figure for a press cycle with overpressing of the lower platen and a standard ejection cycle. The ratio of the Y components of the ejection portion DK and compaction portions CJ of the lissajous figure (1.6:1) indicates overpressing with the lower platen. Overpressing with the lower platen is an infrequent problem which is easily diagnosed by the operator because of the visible sign of powder being pushed out of the top of the die cavity at the beginning of the compaction portion of the cycle before the upper ram closes off the top of the die cavity.

FIG. 9(*d*) illustrates a lissajous figure for a press cycle with the lower platen speed decreased and a standard ejection cycle. The slopes of both the compaction portion CJ and ejection portion DK of the lissajous figure are less than 45° to the horizontal, indicating that the upper platen speed was greater than that of the lower platen. The ratio of the Y components of the ejection and compaction portions of the lissajous figure indicates that compaction by both platens was equal but at different speeds. The ejection speed of the upper platen exceeded the lower platen speed sufficiently to totally remove hold-down pressure during ejection. The change in slope during compaction indicates upper platen deceleration upon compaction pressure build-up since its speed is initially greater than that of the lower platen.

FIG. 9(*e*) illustrates a lissajous figure for a press operation using hydraulic hold-down force. In this press operation hold-down force was only generated with back pressure. No weight control pressure was established. The lissajous figure indicates equal compaction by upper and lower platens but initially at different speeds (the lower platen is slower). The horizontal portion of lissajous figure normally present (see, for example, 82 in FIG. 9(*a*)) at the beginning of ejection portion of the lissajous figure is eliminated indicating that the upper ram and lower ram are simultaneously withdrawn. The non-linear slope of the ejection portion of the lissajous figure is believed to indicate pressure build-up on the bottom side of the piston in the upper hydraulic actuator.

FIG. 9(*f*) illustrates a lissajous figure for a press operation using hydraulic hold-down force generated from manipulation of both the weight control and back pressures. The curve indicates equal compaction by the upper and lower platens showing that compaction is unaffected by the weight control pressure. The weight control pressure was established at the start of the ejection portion of the press cycle which caused the upper platen to withdraw at a faster speed than the lower platen on ejection. This is indicated by an initial ejection slope less than 45° to the horizontal. This is believed to occur because only a few microseconds are available in which to decompress, establish the weight control pressure and then establish the back pressure. The initially faster speed of the upper platen results from a failure to establish sufficient back pressure at the start of the ejection cycle. This press operation was run again in FIG.

9(g) with dwell. Dwelling of the rams at the point of maximum compression is used when the powder being pressed has poor compaction properties. A comparison of the lissajous figures of FIGS. 9(g) and 9(f), obtained with and without dwell, indicates that the normal operation of the press is unaffected by dwell.

Figure 9A:
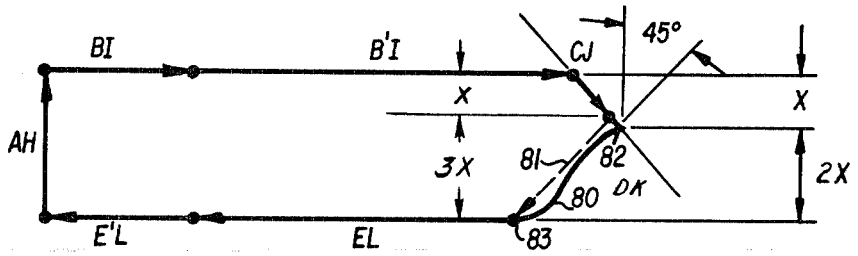
FIGS 9(*a*) through 9(*i*) are examples of lissajous figures constructed according to the invention.
Figure 9B:
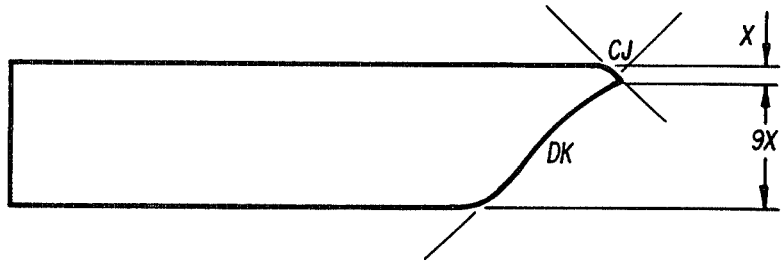
Figure 9C:
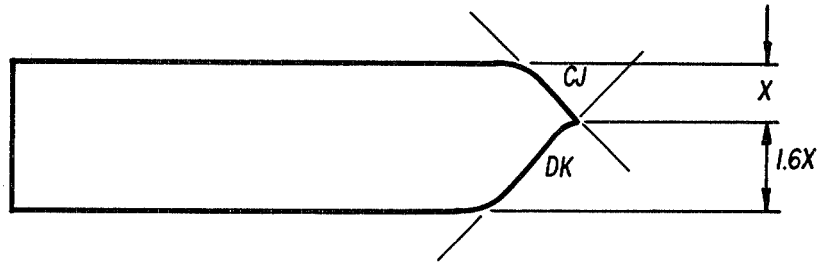
Figure 9D:
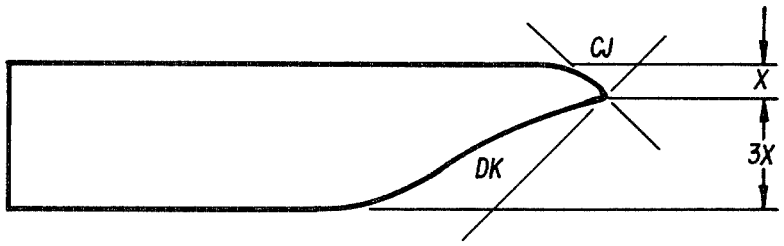
Figure 9E:
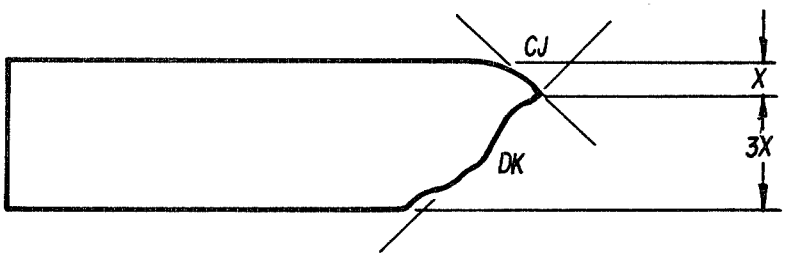
Figure 9F:
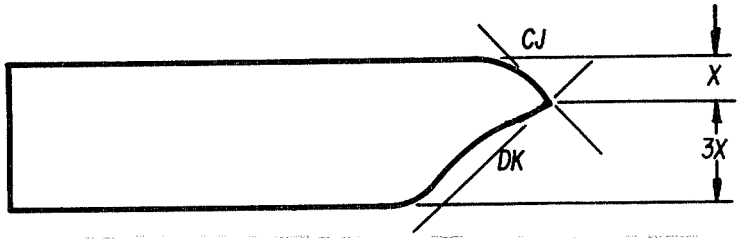
Figure 9G:
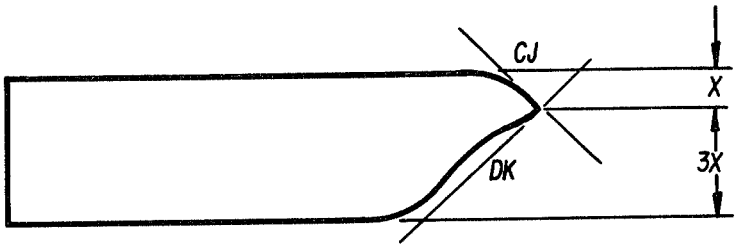
Figure 9H:
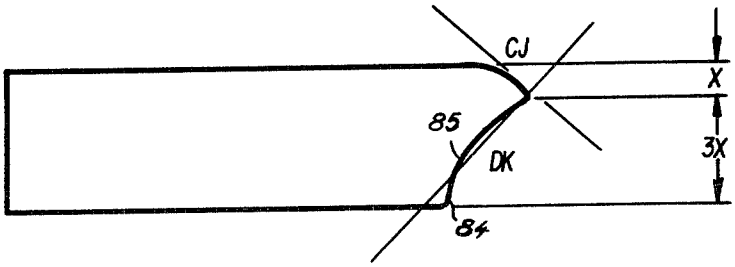
Figure 9I:
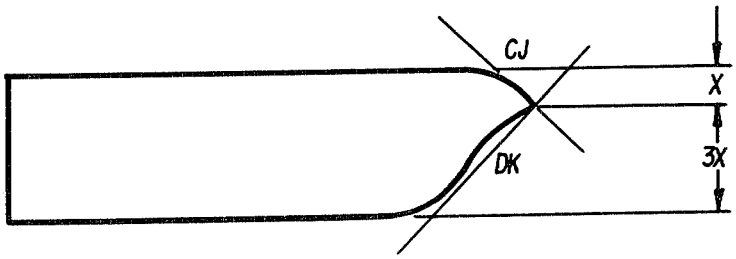

FIGS. 9(h) and 9(i) illustrate lissajous figures for a press operations using hydraulic hold-down force generated with weight control and back pressure. FIG. 9(i) represents a press cycle that yields acceptable pellets. FIG. 9(h) shows the result of increasing the back pressure until the pellet is crushed. The curves show equal compaction by the upper and lower platens. Pellet crushing during the ejection cycle is indicated by the vertical slope, identified by the numeral 84, at the end of the ejection portion DK of the lissajous figure of FIG. 9(h). Back pressure increase is evidenced by a line 85 which tends to exceed a 45° angle just prior to the crushing point. Back pressure increase is also evidenced in the comparison of the ejection portions of the lissajous figures of FIGS. 9(h) and 9(i). Less horizontal travel (less upper platen speed) verifies increased back pressure which prevents the upper platen from accelerating ahead of the lower ram.

The analysis of the illustrative lissajous figures shown in FIG. 9 in terms of press operations makes it clear that the lissajous figures constructed according to the invention provide the operator of a dual platen press with an excellent diagnostic tool, as well as providing a method for monitoring the operation of the press. With this new tool for analyzing press operations and relating them to fuel pellet quality it is now possible to more quickly identify the correct pressing parameters for a given type of $UO_2$ powder. Duplicating a good press set-up for a $UO_2$ powder having known pressing requirements, and thus a known lissajous figure, becomes a matter of adjusting the press so that it duplicates the correct lissajous figure. The continued operation of the press with the desired pressing parameters is ensured as long as the lissajous figures constructed from the platen displacements correspond to the lissajous figure developed from the desired platen displacements.

While the invention has particular advantages when applied to a press used in the manufacture of nuclear fuel pellets, it should be understood that the invention may be advantageously employed to monitor the operation, analyze the pressing cycle and control the operation of any type of manufacturing operation in which a dual platen press is used.

Other modifications of the invention will occur to those skilled in the art and it is desired to cover in the appended claims all of such modifications as fall within the scope of the invention.

What is claimed as new and desired to be secured by Letters Patent of the United States is:

1. A method for monitoring the operation of a dual platen press including a first platen and a second platen subject to displacement with variable velocity toward and away from each other during a cycle of operation, the method comprising the steps of:

indicating the displacement of said first platen;

indicating the displacement of said second platen; and imposing said displacements on orthogonal axes such that said displacements jointly control the motion of a point which traces a first lissajous figure representative of the displacement and relative velocity of said platens.

2. The method of claim 1 further including the step of:

superimposing a second lissajous figure representing desired platen displacement and over said first lissajous figure to facilitate comparison between said first lissajous figure and said second lissajous figure.

3. A method for monitoring and controlling the operation of a dual platen press including a first platen and a second platen subject to displacement with variable velocity toward and away from each other during a cycle of operation, the method comprising the steps of:

indicating the displacement of said first platen;

indicating the displacement of said second platen;

imposing said indicated displacements on orthogonal axes such that said displacements jointly control the motion of a point which traces a first lissajous figure representative of the displacement and relative velocity of said platens, the completion of said figure coinciding with the completion of the cycle of operation of said platens;

detecting the completion of preselected portions of said first lissajous figure; and triggering subsequent operations of the cycle of operation in response to the detection of the completion of said preselected portions of said first lissajous figure for controlling the operation of the press.

4. A method for monitoring the operation of a dual platen press including a first platen and a second platen subject to displacement with variable velocity toward and away from each other during a cycle of operation, the method comprising the steps of:

generating a first electrical signal representative of the displacement of said first platen;

generating a second electrical signal representative of the displacement of said second platen; and imposing said signals on orthogonal axes such that said signals jointly control the motion of a point which traces a first lissajous figure representative of the displacement and relative velocity of said platens.

5. The method of claim 4 further including the step of:

superimposing a second lissajous figure representing desired platen displacement and relative velocity on said orthogonal axes over said first lissajous figure to facilitate comparison between said first lissajous figure and said second lissajous figure.

6. A method for monitoring and controlling the operation of a dual platen press including a first platen and a second platen subject to displacement with variable velocity toward and away from each other during a cycle of operation, the method comprising the steps of:

generating a first electrical signal representative of the displacement of said first platen;

generating a second electrical signal representative of the displacement of said second platen;

imposing said signals on orthogonal axes such that said signals jointly control the motion of a point which traces a first lissajous figure representative of the displacement and relative velocity of said platens;

detecting the completion of preselected portions of said first lissajous figure; and triggering subsequent operations of the cycle of operation in response to the detection of the completion of said preselected portions of said first lissajous figure for controlling the operation of said press.

7. A method for monitoring the operation of a dual platen press used in the manufacture of nuclear fuel pellets, said press including a first platen and a second platen subject to displacement with variable velocity toward and away from each other during a cycle of operation, the method comprising the steps of:

generating a first electrical signal representative of the displacement of said first platen;

generating a second electrical signal representative of the displacement of said second platen; and imposing said signals on orthogonal axes such that said signals jointly control the motion of a point which traces a first lissajous figure representative of the displacement and relative velocity of said platens.

* * * * *